US010889113B2

(12) United States Patent
Oohashi et al.

(10) Patent No.: US 10,889,113 B2
(45) Date of Patent: Jan. 12, 2021

(54) RECORDING ELEMENT BOARD, LIQUID EJECTION APPARATUS AND METHOD OF MANUFACTURING RECORDING ELEMENT BOARD

(71) Applicant: CANON KABUSHIKI KAISHA, Tokyo (JP)

(72) Inventors: Ryoji Oohashi, Yokohama (JP); Tsubasa Funabashi, Yokohama (JP); Koichi Omata, Kawasaki (JP); Hideo Tamura, Kawasaki (JP); Kousuke Kubo, Kawasaki (JP); Yohei Osuki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/505,512

(22) Filed: Jul. 8, 2019

(65) Prior Publication Data

US 2020/0016896 A1 Jan. 16, 2020

(30) Foreign Application Priority Data

Jul. 11, 2018 (JP) ..... 2018-131489

(51) Int. Cl.
*B41J 2/16* (2006.01)
*B41J 2/14* (2006.01)

(52) U.S. Cl.
CPC ..... *B41J 2/14129* (2013.01); *B41J 2/1601* (2013.01); *B41J 2/1628* (2013.01); *B41J 2/1631* (2013.01); *B41J 2/1603* (2013.01); *B41J 2/1642* (2013.01); *B41J 2/1646* (2013.01); *B41J 2202/18* (2013.01)

(58) Field of Classification Search
CPC .... B41J 2/14129; B41J 2/1601; B41J 2/1628; B41J 2/1631; B41J 2/1603; B41J 2/1642; B41J 2/1646; B41J 2202/18
See application file for complete search history.

(56) References Cited

U.S. PATENT DOCUMENTS

2005/0231557 A1* 10/2005 Krawczyk ..... B41J 2/14129 347/54

FOREIGN PATENT DOCUMENTS

JP 2015-202644 A 11/2015
JP 2015202644 A * 11/2015 ..... B41J 2/14112

* cited by examiner

*Primary Examiner* — Yaovi M Ameh
(74) *Attorney, Agent, or Firm* — Canon U.S.A., Inc., IP Division

(57) ABSTRACT

A recording element board has a plurality of heat-generating resistor elements arranged in a row and each of the plurality of heat-generating resistor elements comprises a heat-generating resistor layer and first and second pairs of electrodes connected to the heat-generating resistor layer. The first and second pairs of electrodes contact the heat-generating resistor layer at the opposite surfaces thereof to each other. The first pair of electrodes is formed as vias, while each surface of the second pair of electrodes is inclined so as to gradually reduce the thickness thereof toward the end thereof.

8 Claims, 10 Drawing Sheets

RECORDING ELEMENT BOARD, LIQUID EJECTION APPARATUS AND METHOD OF MANUFACTURING RECORDING ELEMENT BOARD

BACKGROUND

Field

The present disclosure relates to a recording element board, to a liquid ejection apparatus and also to a method of manufacturing such a recording element board.

Description of the Related Art

A liquid ejection apparatus is known as a type of information output apparatus for recording information in the form of characters, images and the like on recording mediums such as paper sheets and films. Liquid ejection apparatuses operate for information recording by causing the liquid ejected from the liquid ejection head thereof to land on a recording medium.

In recent years, in response to the technological advancement of realizing liquid ejection apparatuses that are capable of producing higher quality images at faster recording speed than ever, there has been a stronger demand for production of highly micronized liquid droplets to be ejected and for densely arranged heat-generating resistor elements, which are components of liquid ejection heads, than ever before.

FIG. 1 of the accompanying drawings is a schematic perspective view of a recording element board 401 that can be mounted in a known liquid ejection head. A plurality of heat-generating resistor elements 103 are arranged on a substrate 100 in the recording element board 401. A liquid supply path 102 is formed on the substrate 100. Additionally, a flow path forming member 300*b* and an ejection orifice forming member 300*a* are arranged on the substrate 100. Ejection orifices 301 are formed through the ejection orifice forming member 300*a* so as to positionally correspond to the respective heat-generating resistor elements 103. Furthermore, terminals 101 are arranged on the substrate 100 to electrically externally power the recording element board 401 and also to receive signals from outside.

As the number of heat-generating resistor elements 103 to be arranged in a recording element board that has the above-described configuration is increased, the substrate may inevitably need to be upsized. For the purpose of suppressing such an upsizing tendency, Japanese Patent Application Laid-Open No. 2015-202644 discloses an arrangement of providing each of the heat-generating resistor elements with a plurality of electrodes. With the arrangement disclosed in Japanese Patent Application Laid-Open No. 2015-202644, the heat-generating region forming area of each of the heat-generating resistor elements can be made variable such that the corresponding ejection orifice can eject a variable amount of liquid. Additionally, heat-generating resistor elements of different types are put together to reduce the total number of heat-generating resistor elements so as to prevent the recording element board from being upsized.

SUMMARY

A recording element board according to the present disclosure has a plurality of heat-generating resistor elements arranged in a row, each of the plurality of heat-generating resistor elements comprising a heat-generating resistor layer to be electrically powered for generating heat to energize liquid contained in a pressure chamber to be arranged beside the heat-generating resistor layer in order to cause the pressure chamber to eject the liquid therefrom; at least a pair of first electrodes formed as vias connected to a surface of the heat-generating resistor layer at a side opposite to the pressure chamber, the pair of first electrodes feeding electrical power to a first part of the heat-generating resistor layer to form a first heat-generating region between the pair of first electrodes; and at least a pair of second electrodes connected to the surface of the heat-generating resistor layer at a side facing the pressure chamber, the pair of second electrodes feeding electrical power to a second part of the heat-generating resistor layer to form a second heat-generating region between the pair of second electrodes, the surfaces of the pair of second electrodes located at the side facing the pressure chamber being inclined so as to gradually reduce the thickness thereof toward respective ends thereof.

Further features of the present disclosure will become apparent from the following description of exemplary embodiments with reference to the attached drawings.

DESCRIPTION OF THE EMBODIMENTS

Figure 1:
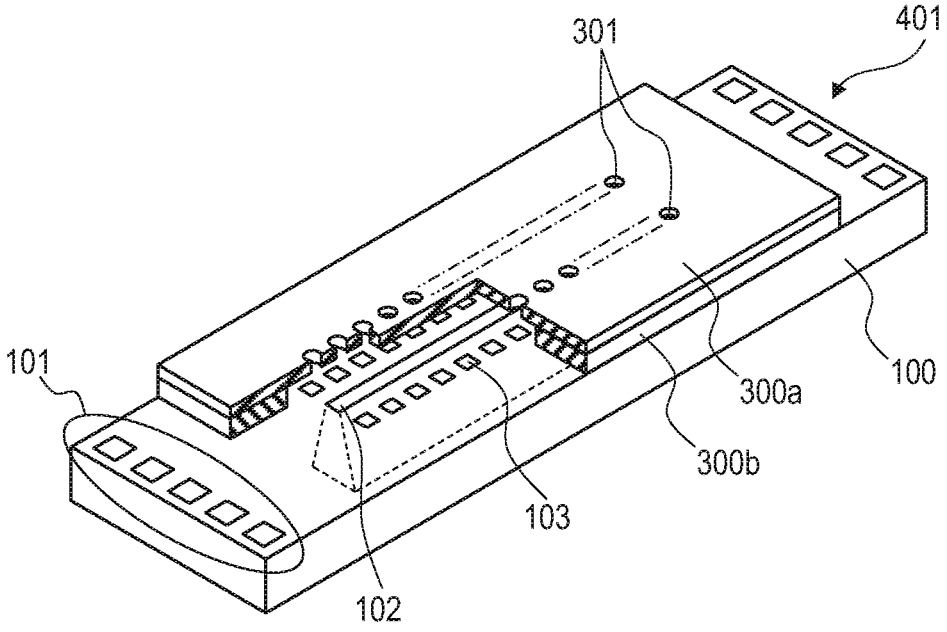
FIG. 1 is a schematic perspective view of a known recording element board.
Figure 2A:
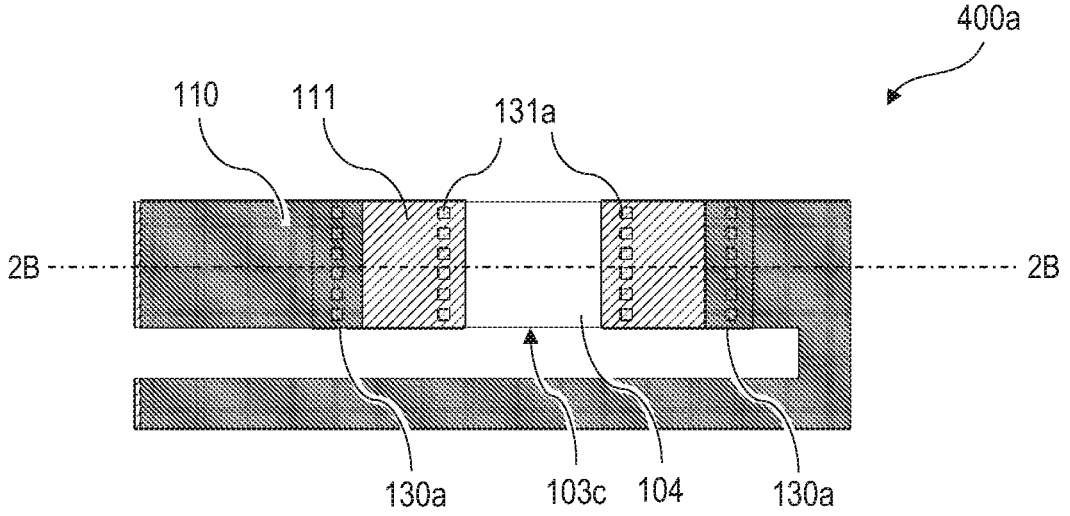
FIGS. 2A and 2B are schematic illustrations of one of the heat-generating resistor elements of a first comparative embodiment of a recording element board and its surroundings.
Figure 2B:
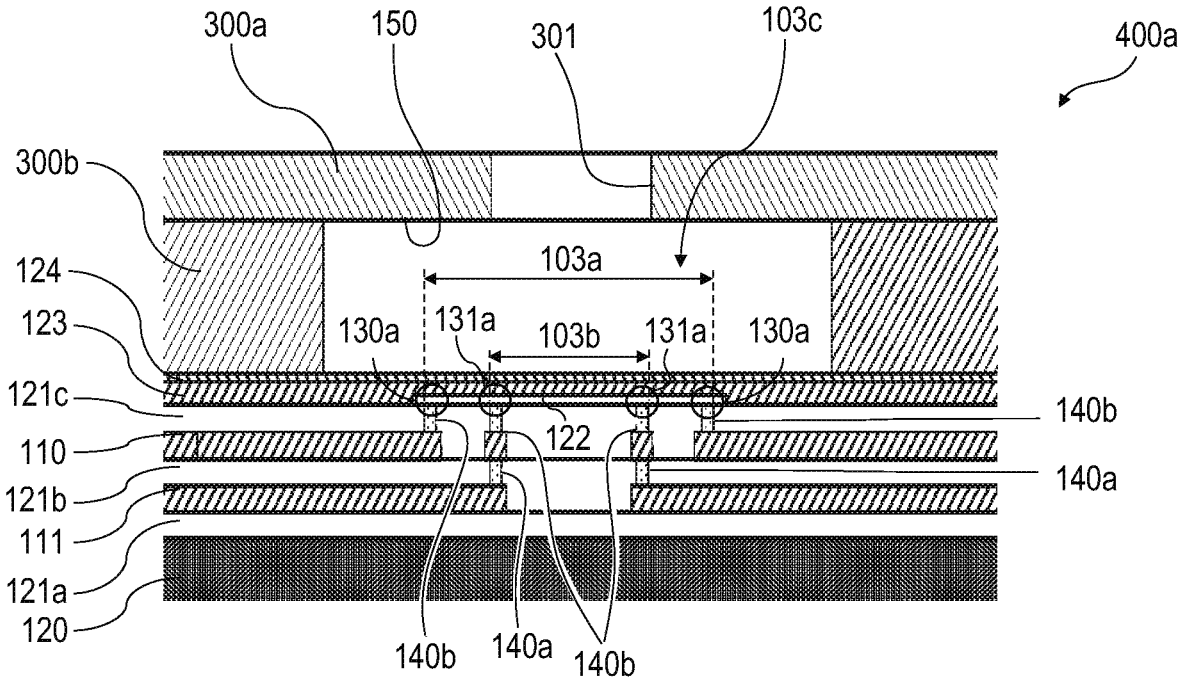

FIG. 2A is a schematic plan view of one of the heat-generating resistor elements 103*c* and its surroundings formed in the recording element board 400*a* of a liquid ejection apparatus having a plurality of heat-generating regions that is designed on the basis of the disclosure of Japanese Patent Application Laid-Open No. 2015-202644. FIG. 2B is a cross-sectional view taken along line 2B-2B in FIG. 2A. As shown in FIG. 2B, a pair of electrode regions 130*a* and another pair of electrode regions 131*a* are arranged respectively at positions located closer to oppositely disposed ends and at positions located closer to the center of the heat-generating resistor element 103*c*. A pair of vias 140*b* is provided, and the vias 140*b* are respectively connected to the electrode regions 130*a*. A pair of vias 140*a* is provided, and the vias 140*a* are respectively connected to the electrode regions 131*a*. The vias 140*a* are respectively connected to the wiring layers 111, while the vias 140*b* are respectively connected to the wiring layers 110. Both the wiring layers 110 and the wiring layers 111 are formed at the side (underside) of the heat-generating resistor element 103*c* opposite to the side thereof where the pressure chamber 150 is arranged.

Thus, the heat-generating regions forming domains are defined in the above-described manner in the liquid ejection apparatus that is designed on the basis of the disclosure of Japanese Patent Application Laid-Open No. 2015-202644. When a plurality of heat-generating resistor elements 103*c* are to be highly densely arranged, for instance at a density of 1,200 dpi, a clear space needs to be provided between two adjacently located heat-generating resistor elements 103*c*, between each of the heat-generating resistor elements 103*c* and the related wiring layers 110 and also between each of the heat-generating resistor elements 103*c* and the related wiring layers 111. Then, for this reason, if a plurality of wiring layers 110, 111 is to be laid out on a single plane, the laying out operation is inevitably subject to spatial restrictions.

In other words, when a plurality of heat-generating resistor elements 103*c* is to be highly densely arranged in such a liquid ejection apparatus, a plurality of electrodes (more specifically a plurality of vias 140*a* and a plurality of vias 140*b*) need to be connected to wiring layers 110 and wiring layers 111 that are arranged on respective planes of different heights. In other words, to realize a liquid ejection apparatus having the above-described configuration, a planarization process is required in order to form a plurality of vias 140*a* that are to be connected to the wiring layers 111 and also to form a plurality of vias 140*b* that are to be connected to the wiring layers 110. Then, the planarization process inevitably pushes up the manufacturing cost accordingly.

In view of the above-described circumstances, therefore, the present disclosure provides a recording element board that can be manufactured at low cost even when heat-generating resistor elements are to be highly densely arranged in it.

First Embodiment

Figure 3:
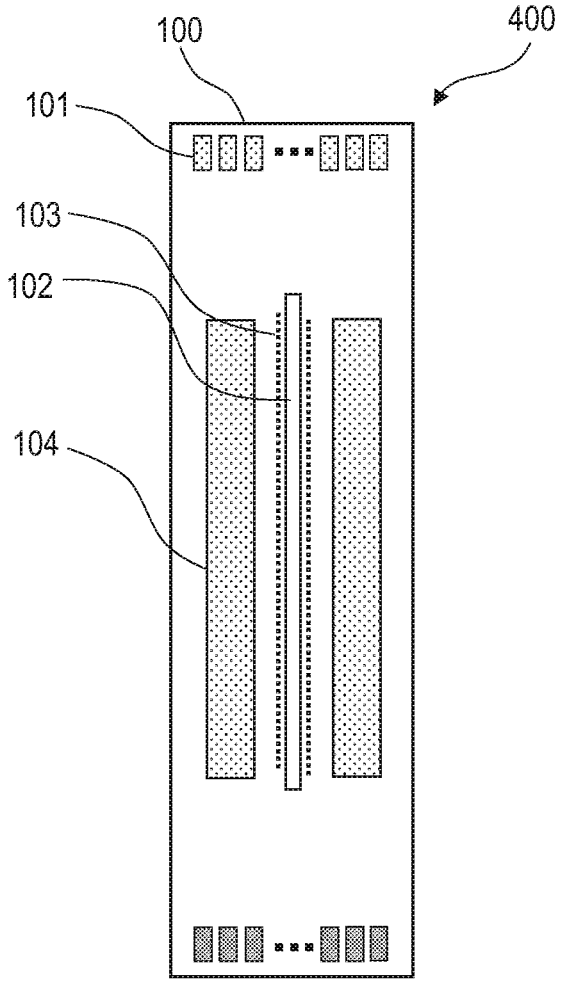
FIG. 3 is a schematic plan view of the first embodiment of recording element board according to the present disclosure.
Figure 4A:
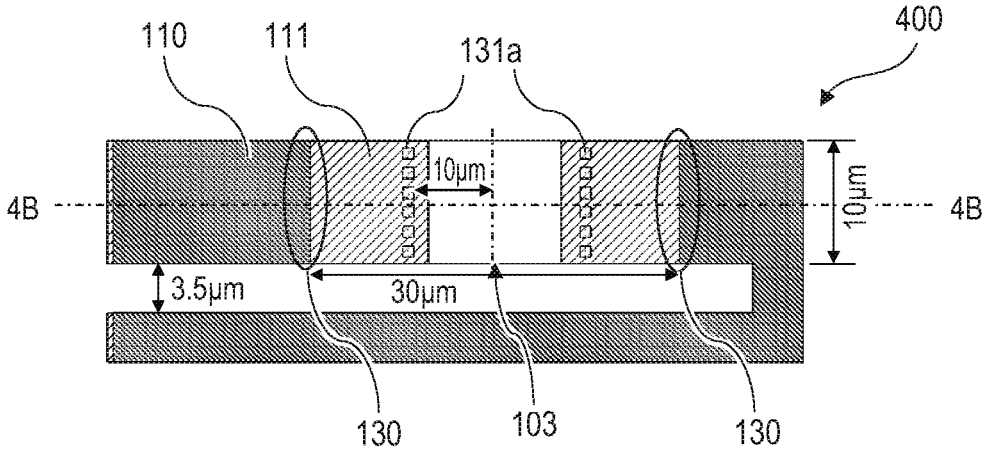
FIGS. 4A and 4B are schematic illustrations of one of the heat-generating resistor elements of the first embodiment of recording element board and its surroundings.
Figure 4B:
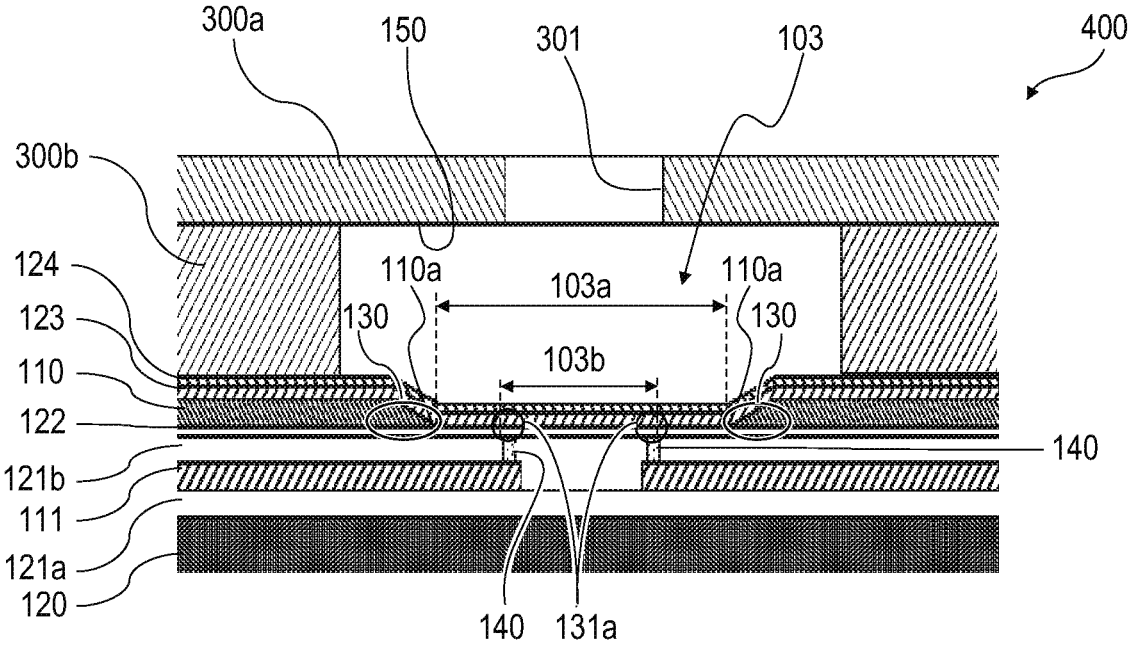

Now, the first embodiment of recording element board according to the present invention will be described by referring to the related drawings. Firstly, the configuration of a recording element board 400 of this embodiment will be described. FIG. 3 is a schematic plan view of the recording element board 400 of this embodiment. FIG. 4A is an enlarged schematic plan view of one of the heat-generating resistor elements 103 and its surroundings formed in the recording element board 400, and FIG. 4B is a schematic cross-sectional view taken along line 4B-4B in FIG. 4A.

In this embodiment, a plurality of (1,024) heat-generating resistor elements 103 is linearly arranged at one of the opposite sides of a long and continuous liquid supply path 102 as viewed in the transverse direction typically at a pitch of 21.0 μm or 21.5 μm so as to realize a resolution of 1,200 dpi. The heat-generating resistor elements 103 are arranged such that the electrodes of each of the heat-generating resistor elements 103 are connected to a heat-generating resistor layer 122 in a manner as described below. As power is supplied by way of the electrodes, the heat-generating resistor layer 122 becomes heated and liquid is ejected by the generated heat.

Each of the heat-generating resistor elements 103 has a width of 10 μm and a length of 30 μm in plan view. A pair of electrode regions 130, which will be described in greater detail hereinafter, is disposed at positions located outside relative to oppositely disposed ends of the heat-generating resistor element 103. The electrode regions 130 are respectively connected to wiring layers 110. The wiring layer 110 that is arranged at the side of drive circuits 104 extends toward the drive circuits 104 with a width that is equal to the width of the heat-generating resistor element 103. On the other hand, the wiring layer 110 that is arranged at the side opposite to the drive circuits 104 extends once to the front of the liquid supply path 102 and then folds back to the side of the drive circuits 104 typically with a width of 4.0 μm (see FIG. 4A). Note that the folding back part of the wiring layer 110 is separated from the heat-generating resistor element 103 and also from the wiring layer 110 extending at the side of the drive circuits 104 typically by a clearance space of 3.5 μm in order to prevent it from interfering with the heat-generating resistor element 103 and the wiring layer 110 extending at the side of the drive circuits 104.

A pair of electrode regions 131*a* is arranged in the domain (at the inside of oppositely disposed ends) of each of the heat-generating resistor elements 103. The electrode regions 131*a* are respectively electrically connected to wiring layers 111, which are arranged below the heat-generating resistor layer 122, by way of vias 140 (which typically operates as so many electrodes, although there are many other electrodes in the recording element board). The wiring layers 111 are respectively arranged below the corresponding wiring layers 110 as viewed in the thickness direction so as to make the layout of the wiring layers 111 to be substantially the same as the layout of the wiring layer 110 as viewed in the surface direction of the wiring layers 111. The pair of electrode regions 131*a* is arranged at positions that are equally separated from the center position of the heat-generating resistor element 103 by 10 μm.

In this embodiment, BPSG (Boron Phospho Silicate Glass) and an interlayer insulation film are formed on a substrate 120 having a thermal oxide layer and drive elements formed thereon by means of CVD (Chemical Vapor Deposition) or the like. The BPSG 121*a* and the interlayer insulation film 121*b* are formed by using a silicon compound. The interlayer insulation film 121*b* is formed typically by using SiO, SiON, SiOC or some other insulating material.

The wiring layers 110 and the heat-generating resistor layer 122 are formed on the substrate 120 so as to produce a pair of electrode regions 130 there, and then a passivation layer 123 and an anti-cavitation layer 124 are formed thereon to cover the wiring layers 110 and the heat-generating resistor layer 122. The pair of electrode regions 131*a* are formed by the wiring layers 111, the pair of vias 140 and the heat-generating resistor layer 122. The wiring layers 110 and the wiring layers 111 are typically made of an aluminum compound such as Al—Si or Al—Cu.

Each of the wiring layers 110 has a tapered part in terms of thickness. More specifically, the paired wiring layers 110 have parts that are tapered in terms of thickness until they get to the respective ends thereof that face each other. The surfaces of the parts are inclined at the side of the pressure chamber 150. As far as this specification is concerned, these ends are referred to as wiring ends 110*a*, and the vias 140 are also referred to as the first electrodes, while the wiring ends 110*a* are also referred to as the second electrodes. The wiring ends 110*a* are typically formed by etching the wiring layers 110. In plan view of the recording element board 400, the pair of wiring ends 110*a* is located outside the pair of vias 140. The pair of electrode regions 131*a* and the pair of electrode regions 130 are electrically connected to the drive circuits 104. The vias 140 are typically made of a metal such as W, Al or Cu.

The wiring layers 111 are formed on the substrate 120 by way of the BPSG 121*a*. More specifically, the wiring layers 111 are formed by forming an Al—Si film by means of sputtering and then by being subjected to a lithography process or a dry etching process. Thus, the recording element board 400 of this embodiment has the above-described configuration.

Figure 5A:
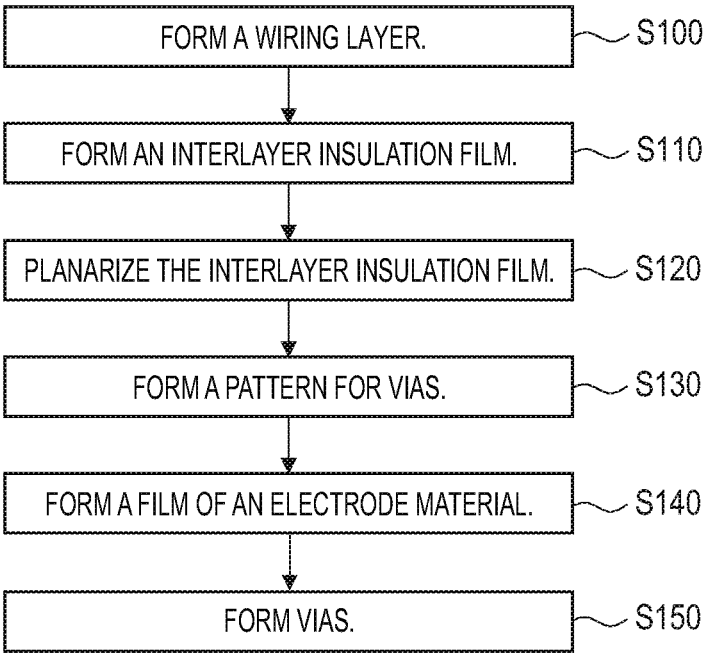
FIGS. 5A and 5B are process charts of the manufacturing process of the first embodiment of recording element board.

Now, the manufacturing process of the recording element board 400 of this embodiment will be described below by referring to the related drawings. FIG. 5A is a process chart of the part of the manufacturing process of the recording element board 400 of this embodiment down to the formation of the vias 140. Firstly, in this process, the wiring layers 111 are formed on the substrate 120 (and the BPSG 121*a*) (S100).

Then, the interlayer insulation film 121*b* is formed by means of CVD (S110). More specifically, the substrate in which the wiring layers 110 have been buried in the inside of the interlayer insulation film 121*b* is now prepared by way of S100 and S110. Thereafter, the interlayer insulation film 121*b* is planarized by means of CMP (chemical mechanical polishing) (S120).

Then, a pattern to be used for the vias 140 is formed on the interlayer insulation film 121*b* by means of lithography and dry etching. More specifically, through holes that connect the surface of the planarized interlayer insulation film 121*b* and the surface of the wiring layers 111 are formed (S130).

Subsequently, a TiN film (a material of electrodes) is formed by sputtering and then a W (tungsten) film (another material of electrodes) is formed by CVD. Thereafter, the insides of the through holes are filled by the material of the vias (S140). The excessive W and the excessive TiN, if any, are removed by CMP and the surface of the interlayer insulation layer 121*b* is planarized. As a result, vias 140 that are filled with W are produced (S150).

Figure 5B:
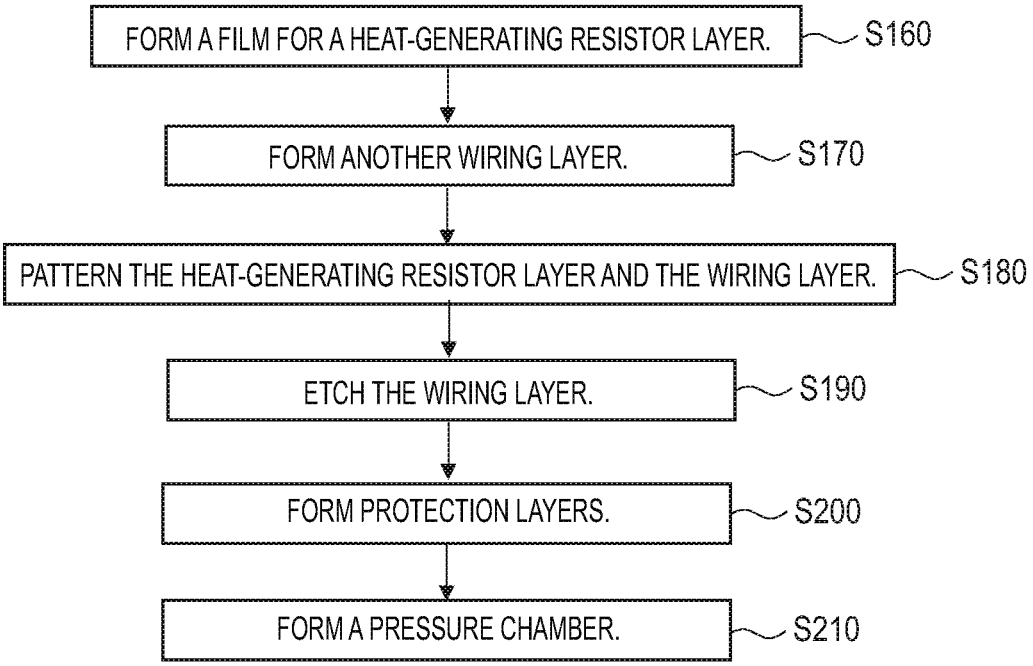

Now, the process part that comes after the formation of the vias 140 of the manufacturing process of the recording element board 400 of this embodiment will be described below. FIG. 5B is a process chart illustrating the formation of the heat-generating resistor layer 122 and the process part that follows the formation of the heat-generating resistor layer 122.

In this process part, the heat-generating resistor layer 122 is formed typically by means of TaSiN on the vias 140 that have been formed by the steps down to S150 (S160) and then a wiring layer 110 is formed thereon by using an Al—Cu film (S170). The wiring layers 110 and the heat-generating resistor layer 122 are collectively subjected to a patterning operation, using lithography and dry etching (S180).

Thereafter, the wiring layer 110 in the region of the heat-generating resistor element 103 is removed by etching the wiring layer 110 that has been formed by using an Al—Cu film to divide the wiring layer 100 into two separate wiring layers 110. At this time, the parts of the wiring layers 110 that are tapered toward the front ends thereof in terms of thickness are also formed (S190). In this embodiment, the tapered parts become so many electrode regions 130.

Subsequently, in this process, the passivation layer 123 that is made of an insulating material, which is a silicon compound such as SiN or SiC, is formed and then the anti-cavitation layer 124 that is typically made of Ta is formed thereon (S200). As the heat-generating resistor element 103 is covered by protection layers including the passivation layer 123 and the anti-cavitation layer 124, the insulation between the heat-generating resistor element 103 and the ink (or some other liquid, not shown) in the recording element board 400 and the anti-cavitation effect at the time of ink ejection are secured. The liquid to be used for the recording element board of this embodiment may not necessarily be ink.

Then, in this process, the flow path forming member 300*b* and the ejection orifice forming member 300*a* are laid on the anti-cavitation layer 124. Thereafter, the ejection orifices 301 are produced by boring holes through the ejection orifice forming member 300*a*. Then, as a result, the pressure chamber 150 that is surrounded by the heat-generating resistor element 103, the flow path forming member 300*b* and the ejection orifice forming member 300*a* is produced (S210). Thus, the manufacturing process of this embodiment of recording element board 400 is described above.

Note that, if the recording element board 400 is employed for an ink ejection head, ink is contained in the pressure chamber 150 and then the contained ink is ejected from the ejection orifice 301 as the heat-generating resistor element 103 is heated to apply ejection energy to the ink contained in the inside of the pressure chamber 150.

Figure 6A:
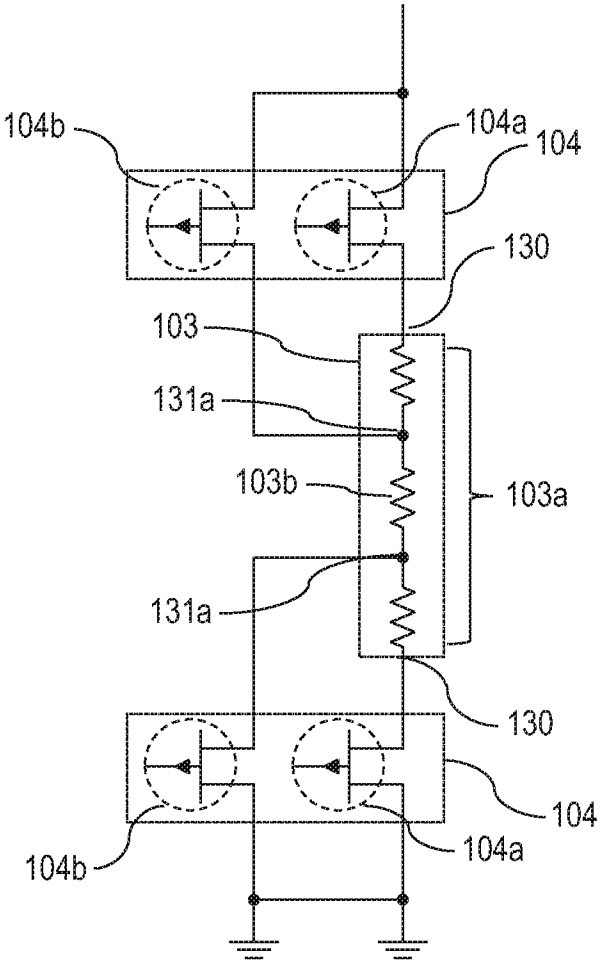
FIGS. 6A, 6B and 6C show an equivalent circuit diagram of the first embodiment of recording element board and the results of selectively using the drive circuits of the equivalent circuit.
Figure 6B:
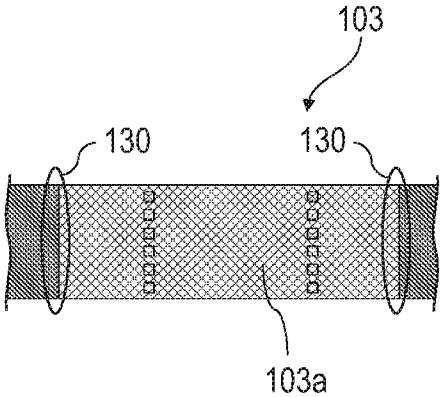
Figure 6C:
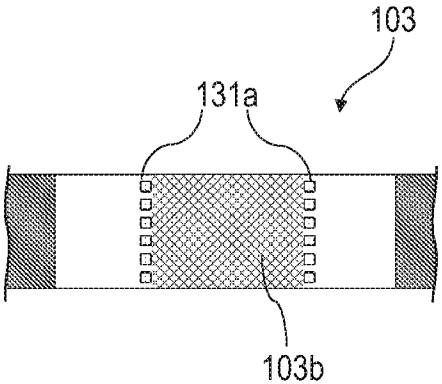

FIG. 6A is an equivalent circuit diagram of the first embodiment of recording element board 400. In this embodiment, the heat-generating region 103*a* located between the electrode regions 130 is made to generate heat by selecting a drive circuits 104*a* (see FIG. 6B), whereas the heat-generating region 103*b* located between the electrode regions 131*a* is made to generate heat by selecting a drive circuit 104*b* (see FIG. 6C).

Now, some of the effects and advantages of this embodiment will be described below by referring to the related drawings. More specifically, some of the effects and advantages of the present disclosure will be described below by comparing this embodiment with the first comparative embodiment shown in FIGS. 2A and 2B. Note that the components of the first comparative embodiment shown in FIGS. 2A and 2B that are the same as their counterparts of this embodiment (FIGS. 4A and 4B) are denoted by the same reference symbols.

The configuration of the recording element board 400*a* of the first comparative embodiment is described above. The vias 140*a* are connected to the wiring layers 111 and the vias 140*b* are connected to the wiring layers 110, the wiring layers 111 and the wiring layers 110 being formed at the side of the heat-generating resistor layer 122 (at the lower side) that is opposite to the side where the pressure chamber 150 is arranged. In the instance of the first comparative embodiment, particularly when a plurality of heat-generating resistor elements 103*c* is highly densely arranged to realize a density of 1,200 dpi, for example, the operation of laying out a plurality of wiring layers 110, 111 on a same plane is subject to restrictions as described above. For this reason, a planarization process is required to be executed to form a plurality of vias 140*a*, 140*b* that are to be respectively connected to the wiring layers 111, 110 in order to arrange the wiring layers 111, 110 one above the other. Then, the manufacturing cost is raised accordingly.

In the instance of this embodiment, on the other hand, some of the electrodes that are connected to the heat-generating resistor layer 122 are arranged at the side of the pressure chamber 150 of the heat-generating resistor layer 122 (see FIG. 4B). More specifically, the wiring layers 110 are connected to the surface of the pressure chamber 150 on the side of the heat-generating resistor layer 122. Therefore, the number of the electrodes (the number of the vias) that are located at the lower side of the heat-generating resistor layer 122 can be reduced in the recording element board 400 of this embodiment if compared with the recording element board 400*a* of the first comparative embodiment. For this reason, heat-generating resistor elements 103 can be arranged more densely in the recording element board 400 of this embodiment than in the recording element board 400*a* of the first comparative embodiment. Then, accordingly, a plurality of ejection orifices 301 can be arranged more densely in a liquid ejection head 180 (see FIG. 10) formed by using the recording element board 400 of this embodiment than in a liquid ejection head formed by using the recording element board 400*a* of the first comparative embodiment.

Figure 10:
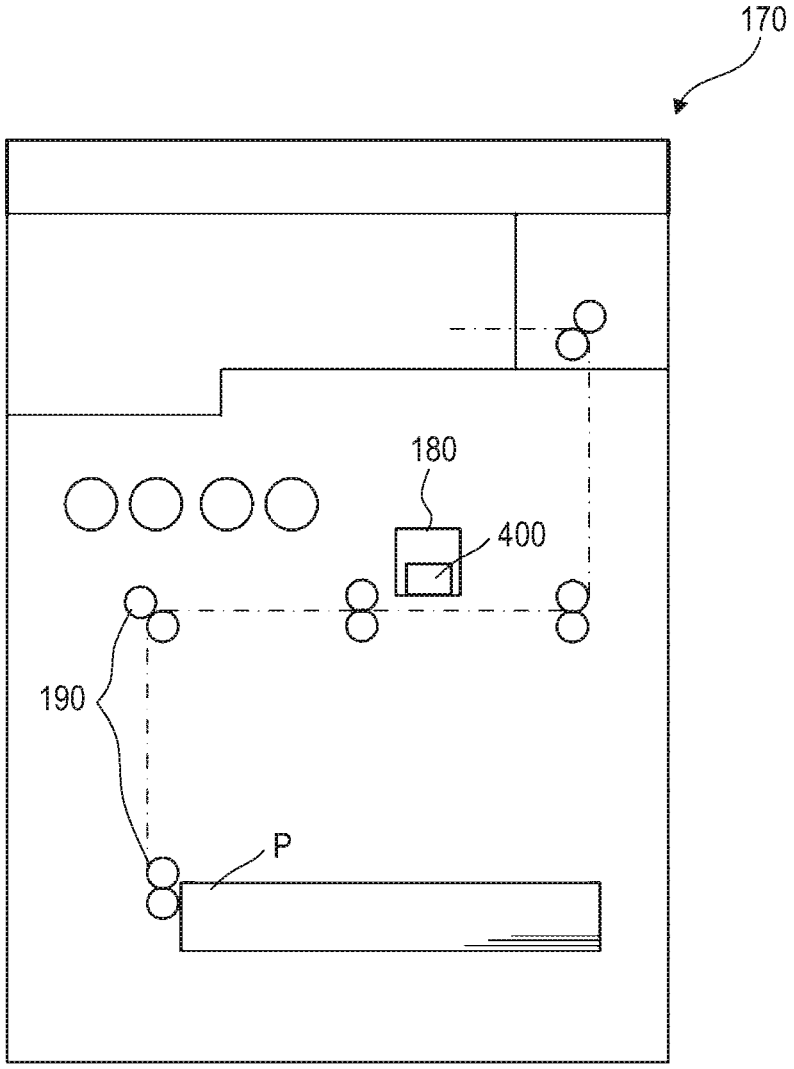
FIG. 10 is a schematic illustration of a liquid ejection apparatus in which the first embodiment of recording element board is mounted.

Additionally, a liquid ejection apparatus 170 (see FIG. 10) that comprises the liquid ejection head 180 of this embodiment can record images with a higher resolution than a liquid ejection apparatus that comprises the liquid ejection head of the first comparative embodiment. Note that the liquid ejection apparatus 170 comprises a conveyor 190 for conveying a sheet of paper P (see FIG. 10, shown as an example of recording medium) to the ink landing position where the ink ejected from the liquid ejection head 180 (recording element board 400) lands.

Unlike the recording element board 400*a* of the first comparative embodiment, some of the electrodes of the recording element board 400 of this embodiment are arranged as part of the wiring layers 110 (as wiring ends 110*a*) (see FIG. 4B). Differently stated, the pair of vias 140*b* of the first comparative embodiment corresponds to the wiring ends 110*a* and, while the wiring layers 110 of the first comparative embodiment are formed below the heat-generating resistor layer 122, the wiring layers 110 of this embodiment are formed on the heat-generating resistor layer 122. For this reason, the thickness of the recording element board 400 of this embodiment can be reduced if compared with the recording element board 400*a* of the first comparative embodiment.

Additionally, the planarization process of the recording element board 400 of this embodiment is reduced from the planarization process of the first comparative embodiment by the operation of planarizing a pair of wiring layers. Thus, manufacturing this embodiment requires less time if compared with manufacturing the first comparative embodiment. Then, as a result, the manufacturing cost of the recording element board 400 of this embodiment can be reduced if compared with the manufacturing cost of the recording element board 400*a* of the first comparative embodiment.

In the instance of the recording element board 400 of this embodiment, some of the plurality of electrodes that are connected to the heat-generating resistor layer 122 are arranged as part of the wiring layer 110 (wiring ends 110*a*). Additionally, the wiring ends 100*a* are tapered in terms of thickness (see FIG. 4B). Therefore, the capacity of the pressure chamber 150 of the recording element board 400 of this embodiment can be raised if compared with an instance where the thickness of the wiring ends is held the same as that of the wiring layers 110 and hence the wiring ends are not tapered in terms of thickness. The above is the description of the first embodiment.

Second Embodiment

Now, the second embodiment of recording element board 400*b* according to the present invention will be described below by referring to the related drawings. In the following description and in FIGS. 7, 8A, 8B and 9A through 9C, the components of this embodiment that are the same as their counterparts of the first embodiment are denoted respectively by the same reference symbols.

Figure 7:
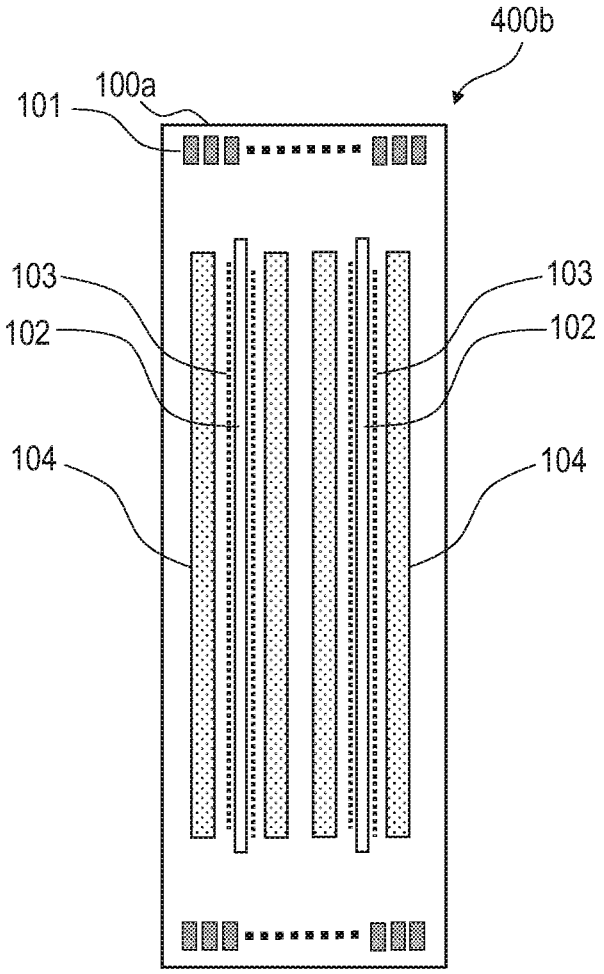
FIG. 7 is a schematic plan view of the second embodiment of the recording element board.
Figure 8A:
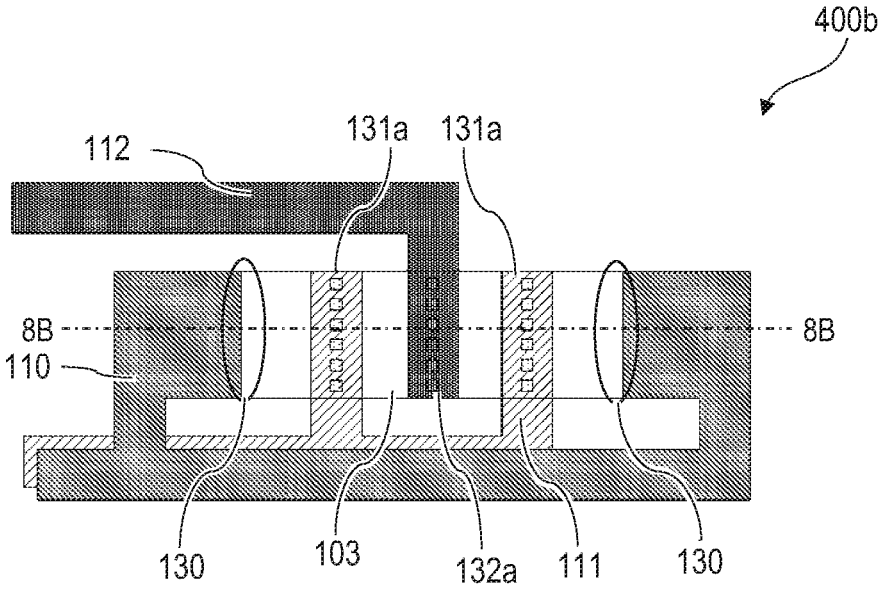
FIGS. 8A and 8B are schematic illustrations of one of the heat-generating resistor elements of the second embodiment of recording element board and its surroundings.
Figure 8B:
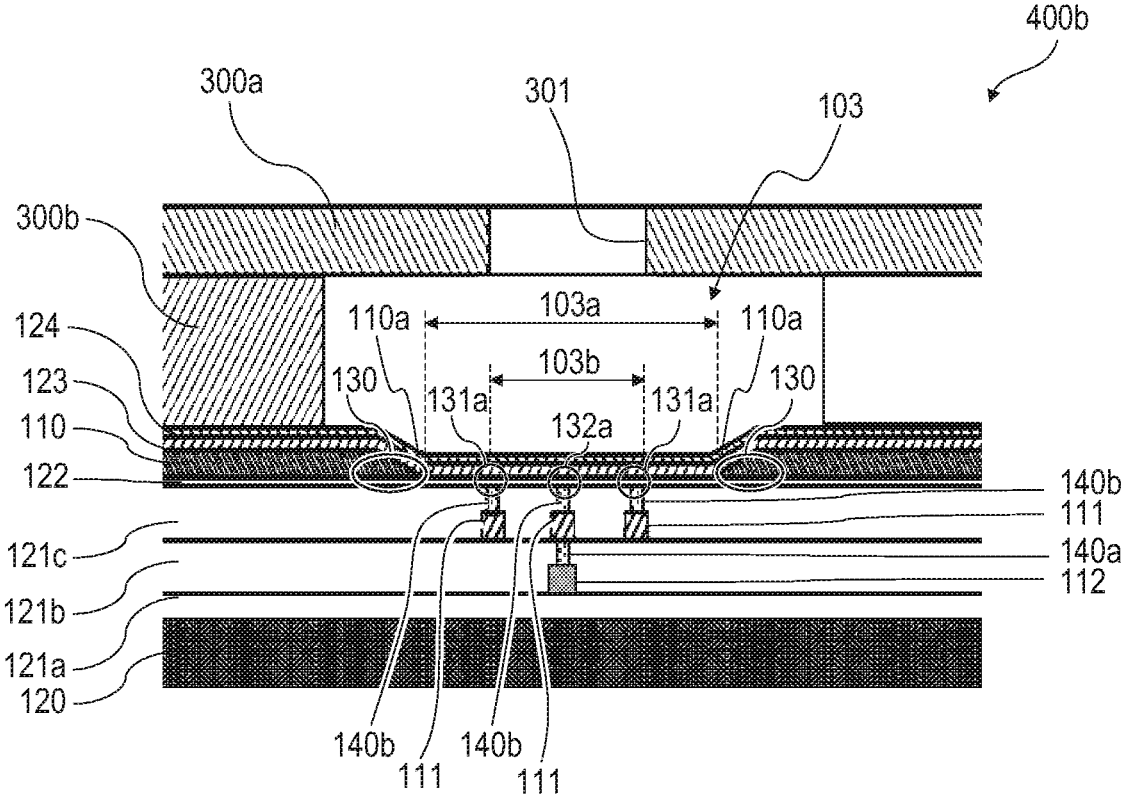

FIG. 7 is a schematic plan view of the recording element board 400*b* of this embodiment. FIG. 8A is an enlarged schematic plan view of one of the heat-generating resistor elements 103 and its surroundings formed in the recording element board 400*b* and FIG. 8B is a schematic cross-sectional view taken along line 8B-8B in FIG. 8A.

This embodiment differs from the above-described first embodiment in a manner as described below. Namely, this embodiment differs from the first embodiment in that two liquid supply paths 102 are provided in the recording element board 400*b* of this embodiment as shown in FIG. 7 and that, for each of the heat-generating resistor elements, two wiring layers including wiring layer 111 and wiring layer 112 are arranged one above the other below the heat-generating resistor layer 122 and connected to the heat-generating resistor layer 122 by way of a via 140*a* and vias 140*b*. The number of heat-generating resistor elements 103 arranged along the each of the opposite sides of each of the liquid supply paths 102 is typically equal to 1,536 as viewed in the transverse direction.

The electrode region 132*a* that is added to the center of each of the heat-generating resistor elements 103 is electrically connected to the wiring layer 112. The heat-generating resistor elements 103 of this embodiment can selectively cause either the heat-generating region 103*a* that is located between the electrode region 132*a* at the center and the pair of electrode regions 130 or the heat-generating region 103*b* that is located between the electrode region 132*a* and the pair of electrode regions 131*a* (see FIGS. 9B and 9C) to generate heat. In other words, the recording element board of this embodiment is so designed that a voltage is to be applied either between the electrode region 132*a* and the pair of electrode regions 131*a* or between the electrode region 132*a* and the pair of electrode regions 130 to make an electric current flow. Therefore, the electrode region 132*a* of this embodiment operates as common electrode to be commonly used as one of the electrodes when a voltage is applied to make the two different heat-generating regions 103*a* and 103*b* individually and selectively generate heat.

Figure 9A:
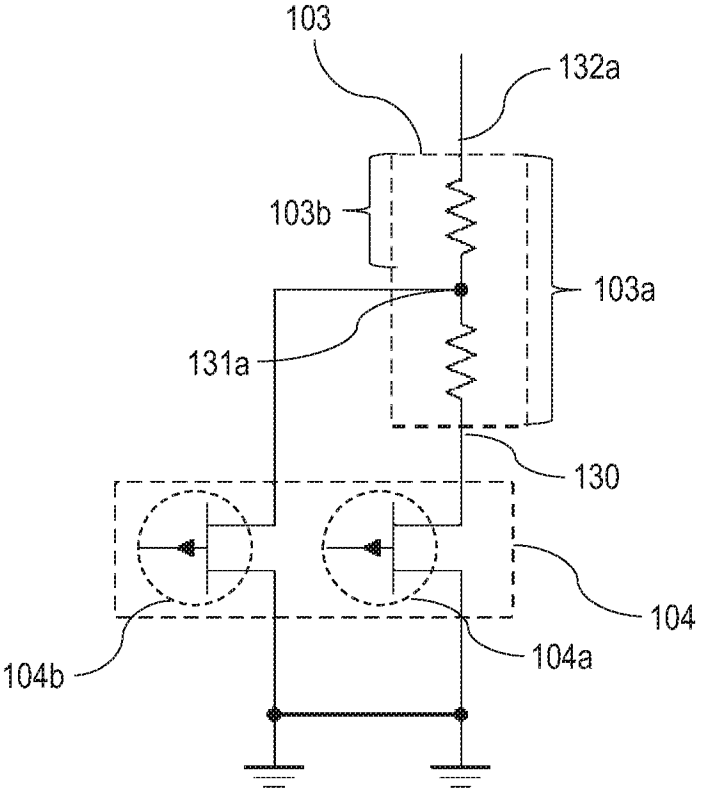
FIGS. 9A, 9B and 9C show an equivalent circuit diagram of the second embodiment of the recording element board and the results of selectively using the drive circuits of the equivalent circuit.
Figure 9B:
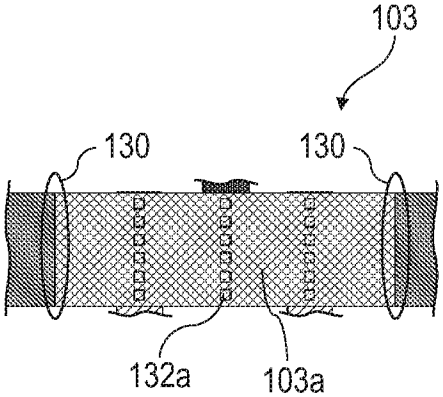
Figure 9C:
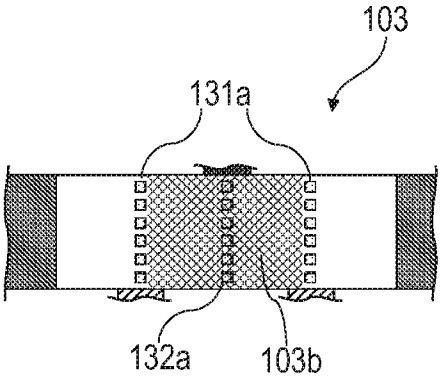

The wiring layers 110 that are connected to the wiring ends 110*a* and the wiring layers 111 that are connected to the electrode regions 131*a* are mutually short-circuited to produce an equivalent circuit as shown in FIG. 9A, which will be described hereinafter. On the other hand, the wiring layers 111 that are connected to the electrode regions 132*a* are electrically connected to the wiring 112 that is newly added by way of the vias 140*b* and the via 140*a* as shown in FIG. 8B.

FIG. 9A shows an equivalent circuit diagram of the recording element board 400*b* of this embodiment. In this embodiment, the heat-generating region 103*a* located between the pair of electrode regions 130 is made to generate heat by selecting the drive circuit 104*a* (see FIG. 9B), whereas the heat-generating region 103*b* located between the pair of electrode regions 131*a* is made to generate heat by selecting the drive circuit 104*b* (see FIG. 9C). Thus, this embodiment differs from the first embodiment in the above-described manner.

Now, some of the effects and advantages of this embodiment will be described below by referring to the related drawings. More specifically, some of the effects and advantages of the present invention will be described below by comparing this embodiment with the second comparative embodiment (not shown). The second comparative embodiment is formed by using a recording element board similar to the recording element board 400*a* (see FIGS. 2A and 2B) of the first comparative embodiment, forming two liquid supply paths 102 and arranging 1,536 heat-generating resistor elements 103 along each of the opposite sides of each of the liquid supply paths 102 as viewed in the transverse direction. Therefore, the recording element board of the second comparative embodiment shows a plan view substantially similar to the plan view (see FIG. 7) of the recording element board 400*b* of this embodiment. Note that the components of the second comparative embodiment that are the same as their counterparts of this embodiment are denoted by the same reference symbols.

By comparing the recording element board 400*b* of this Embodiment with the recording-element board of the second comparative embodiment, it will be seen that the member of processes of this embodiment is raised to cover the step of forming the wiring layers 110 and the wiring ends 110*a* of the wiring layers 110 on the heat-generating resistor layer 122 if compared with the second comparative embodiment. However, on the other hand, the substrate of this embodiment can be downsized (and hence the dimensions of the recording element board of this embodiment can be reduced) if compared with the second comparative embodiment. In instances of arranging a plurality of heat-generating resistor elements 103 in rows, the cost reduction realized by downsizing the substrate has more effect than compensating for the cost increase of adding the etching step of forming the wiring ends 110*a* of the wiring layers 110. In other words, the cost of manufacturing the recording element board 400*b* of this embodiment is lower than the cost of manufacturing the recording element board of the second comparative embodiment.

In the instance of the recording element board 400*b* of this embodiment, the electrode region 132*a* operates as one of the electrodes for applying a voltage to cause the two different heat-generating regions 103*a* and 103*b* to individually generate heat and hence as the common electrode for selectively causing the heat-generating regions to generate heat. Thus, while the heat-generating regions respectively require two drive circuits 104*a* and 104*b* in the second comparative embodiment, the heat-generating regions requires only a single drive circuit in this embodiment (see FIG. 6A and FIG. 9A). Then, as a result, when the drive circuits 104*a*, 104*b* are arranged side by side in a surface direction in this embodiment, the area required for the drive circuit section of a single heat-generating resistor element 103 of this embodiment can be reduced to about a half of the area required for the drive circuit section of a single heat-generating resistor element 103 of the second comparative element. For the above-described reason that a common electrode 132*a* is provided for each of the heat-generating resistor elements 103, the substrate of the recording element board 400*b* of this embodiment can be downsized even if compared with the first embodiment. Otherwise, this embodiment provides effects and advantages similar to those of the first embodiment. Thus, the above is the description of the second embodiment of recording element board according to the present invention.

While the present invention is described above by way of the first and second embodiments, the technological scope of the present invention is by no means limited by the above-described embodiments.

For example, each of the via-related electrode regions is formed by using a plurality of vias 140 in the first and second embodiments. However, an electrode region may alternatively be formed by using a single via whose planar layout is rectangular, more specifically a single via that extends in the direction in which a plurality of vias 140 is linearly arranged. Such a modified arrangement provides effects and advantages similar to those of the above-described embodiments.

While two types of heat-generating region are provided for each of the heat-generating resistor elements 103 (and hence for each of the pressure chambers 150) in each of the above-described first and second embodiments, three or more types of heat-generating region may alternatively be provided. Such an arrangement can be made feasible by simply adding electrodes. Such a modified arrangement also provides effects and advantages similar to those of the above-described embodiments.

Furthermore, two groups of a plurality of heat-generating resistor elements 103 that are linearly arranged are provided so as to sandwich each of the two liquid supply paths in the second embodiment. However, conversely, a single group of a plurality of heat-generating resistor elements 103 may linearly be arranged so as to be sandwiched between two liquid supply paths 102. Again, such a modified arrangement also provides effects and advantages similar to those of the above-described embodiments.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-131489, filed Jul. 11, 2018, which is thereby incorporated by reference herein in its entirety.

What is claimed is:

1. A recording element board having a plurality of heat-generating resistor elements arranged in a row, each of the plurality of heat-generating resistor elements comprising:

a heat-generating resistor layer to be electrically powered for generating heat to energize liquid contained in a pressure chamber to be arranged beside the heat-generating resistor layer in order to cause the pressure chamber to eject the liquid therefrom;

at least a pair of first electrodes formed as vias connected to a surface of the heat-generating resistor layer at a side opposite to the pressure chamber, the pair of first electrodes feeding electrical power to a first part of the heat-generating resistor layer to form a first heat-generating region between the pair of first electrodes; and at least a pair of second electrodes connected to the surface of the heat-generating resistor layer at a side facing the pressure chamber, the pair of second electrodes feeding electrical power to a second part of the heat-generating resistor layer to form a second heat-generating region between the pair of second electrodes, wherein surfaces of the pair of second electrodes located at the side facing the pressure chamber being inclined so as to gradually reduce the thickness thereof toward respective ends thereof, wherein each of the heat-generating resistor elements has a common electrode connected to the heat-generating resistor layer so as to be commonly used both when the first heat-generating region is formed and when the second heat-generating region is formed; and wherein the common electrode is formed as a via and arranged between the pair of first electrodes in a plan view of the recording element board.

2. The recording element board according to claim 1, wherein the pair of first electrodes is arranged between the pair of second electrodes in a plan view of the recording element board.

3. The recording element board according to claim 2, wherein the second heat-generating region includes the first heat-generating region and a region of the heat-generating resistor layer located outside of the first heat-generating region.

4. The recording element board according to claim 1, wherein each of the heat-generating resistor elements has:

a first drive circuit for feeding power to the first part by way of the pair of first electrodes, and a second drive circuit for feeding power to the second part by way of the pair of second electrodes.

5. The recording element board according to claim 1, wherein the common electrode is arranged in a center part of the first heat-generating region in the plan view of the recording element board.

6. A liquid ejection apparatus comprising:

a recording element board having a plurality of heat-generating resistor elements arranged in a row, each of the plurality of heat-generating resistor elements comprising:

a heat-generating resistor layer to be electrically powered for generating heat to energize liquid contained in a pressure chamber to be arranged beside the heat-generating resistor layer in order to cause the pressure chamber to eject the liquid therefrom;

at least a pair of first electrodes formed as vias connected to a surface of the heat-generating resistor layer at a side opposite to the pressure chamber, the pair of first electrodes feeding electrical power to a first part of the heat-generating resistor layer to form a first heat-generating region between the pair of first electrodes; and at least a pair of second electrodes connected to the surface of the heat-generating resistor layer at a side facing the pressure chamber, the pair of second electrodes feeding electrical power to a second part of the heat-generating resistor layer to form a second heat-generating region between the pair of second electrodes, wherein surfaces of the pair of second electrodes located at the side facing the pressure chamber being inclined so as to gradually reduce the thickness thereof toward respective ends thereof; and a conveyor for conveying a recording medium to a liquid landing position where the recording medium receives the liquid ejected from the recording element board, wherein each of the heat-generating resistor elements has a common electrode connected to the heat-generating resistor layer so as to be commonly used both when the first heat-generating region is formed and when the second heat-generating region is formed; and wherein the common electrode is formed as a via and arranged between the pair of first electrodes in a plan view of the recording element board.

7. A method of manufacturing a recording element board having a plurality of heat-generating resistor elements arranged in a row, each of the plurality of heat-generating resistor elements comprising a heat-generating resistor layer to be fed with electrical power for generating heat to energize liquid contained in a pressure chamber to be arranged beside the heat-generating resistor element in order to cause the pressure chamber to eject the liquid therefrom and a plurality of electrodes connected to the heat-generating resistor layer so as to feed the power to the heat-generating resistor layer, the method comprising, for forming each of the plurality of heat-generating resistor elements:

preparing a substrate having an insulation film containing a wiring layer buried therein;

planarizing the insulation film;

forming at least a pair of first electrodes among the plurality of electrodes as vias by forming through holes in the insulation film and filling the insides of the through holes with a via material:

forming the heat-generating resistor layer so as to contact the pair of first electrodes to thereby form a first heat-generating region in a first part of the heat-generating resistor layer located between the pair of first electrodes;

forming a wiring layer so as to contact the heat-generating resistor layer; and forming at least a pair of second electrodes among the plurality of electrodes by etching the wiring layer so as to remove part thereof to thereby form a second heat-generating region in a second part of the heat-generating resistor layer located between the pair of second electrodes, wherein each of the heat-generating resistor elements has a common electrode connected to the heat-generating resistor layer so as to be commonly used both when the first heat-generating region is formed and when the second heat-generating region is formed; and wherein the common electrode is formed as a via and arranged between the pair of first electrodes in a plan view of the recording element board.

8. The method of manufacturing a recording element board according to claim 7, wherein the at least pair of second electrodes is formed so as to sandwich the at least pair of first electrodes between them in a plan view of the substrate.

* * * * *